US006445119B1

(12) United States Patent
Mori et al.

(10) Patent No.: US 6,445,119 B1
(45) Date of Patent: Sep. 3, 2002

(54) COMBINED LIGHT EMITTING DISCHARGE LAMP AND LUMINAIRE USING SUCH LAMP

(75) Inventors: Toshio Mori, Settsu; Hiromi Tanaka, Ibaraki; Kenji Mukai, Shijonawate; Toru Higashi, Takatsuki; Tetsuji Takeuchi, Kyotanabe; Haruo Shibata, Takatsuki; Sueko Kanaya, Ibaraki; Katsuaki Iwama, Suita, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/264,483

(22) Filed: Mar. 8, 1999

(30) Foreign Application Priority Data

Mar. 24, 1998 (JP) ..... 10-075260
Nov. 4, 1998 (JP) ..... 10-312901

(51) Int. Cl.[7] ..... H01J 1/62; H01J 63/04

(52) U.S. Cl. ..... 313/485; 313/483; 313/486; 313/487

(58) Field of Search ..... 313/483, 484, 313/485, 486, 487

(56) References Cited

U.S. PATENT DOCUMENTS

| | | | | | |
|---|---|---|---|---|---|
| 4,602,188 | A | * | 7/1986 | de Hair et al. | 313/487 |
| 4,623,816 | A | * | 11/1986 | Hoffman et al. | 313/487 |
| 4,716,337 | A | * | 12/1987 | Huiskes et al. | 313/487 |
| 5,049,779 | A | * | 9/1991 | Isuki et al. | 313/486 |
| 5,714,836 | A | * | 2/1998 | Hunt et al. | 313/487 |
| 5,757,447 | A | * | 5/1998 | Kobayashi et al. | 313/487 |
| 5,770,917 | A | * | 6/1998 | Yano et al. | 313/486 |
| 5,854,533 | A | * | 12/1998 | Pappalardo | 313/487 |
| 5,907,216 | A | * | 5/1999 | Ligthart et al. | 313/490 |

FOREIGN PATENT DOCUMENTS

| | | | | |
|---|---|---|---|---|
| EP | 0 100 122 A | | 2/1984 | |
| EP | 0 229 428 A | | 7/1987 | |
| EP | 0395 775 A | | 11/1990 | |
| EP | 0762474 A2 | | 3/1997 | |
| JP | 58066247 A | * | 4/1983 | 313/599 |
| JP | 62-27500 | | 6/1987 | |
| JP | 6-36746 | | 2/1994 | |
| JP | 8-153491 | | 6/1996 | |
| JP | 9-161724 | | 6/1997 | |
| JP | 10-214600 | | 8/1998 | |

OTHER PUBLICATIONS

European Patent Office Search Report, Aug. 4, 1993, 3 pages.

* cited by examiner

*Primary Examiner*—Nimeshkumar D. Patel
*Assistant Examiner*—Mariceli Santiago
(74) *Attorney, Agent, or Firm*—Rosenthal & Osha L.L.P.

(57) ABSTRACT

A discharge lamp which radiates visible light having the following lights combined: light having an emission peak in 400 to 490 nm wavelength range in a blue spectral region; light having an emission peak in a 500 to 550 nm wavelength range in a green spectral region; and light having an emission peak in 600 to 670 nm wavelength range in a red spectral region. The color point of the radiated light lies within a region common to the following regions: a region bounded by an ellipse with a color point (u, v)=(0.224, 0.330) as a center thereof, a major axis of 0.056, a minor axis of 0.024, and an angle from the u axis of 20 degrees in the CIE 1960 UCS diagram; a region bounded by an ellipse with a color point (u, v)=(0.224, 0.330) as a center thereof, a major axis of 0.078, a minor axis of 0.014, and an angle from the u axis of 30 degrees in the CIE 1960 UCS diagram; a region bounded by an ellipse with a color point (u, v)=(0.235, 0.335) as a center thereof, a major axis of 0.060, a minor axis of 0.030, and an angle from the u axis of 30 degrees in the CIE 1960 UCS diagram; a region bounded by an ellipse with a color point (u, v)=(0.225, 0.330) as a center thereof, a major axis of 0.060, a minor axis of 0.018, and an angle from the u axis of 20 degrees in the CIE 1960 UCS diagram; and a region on a side of color temperature lower than an isotemperature line of a correlated color temperature of 3500 K.

26 Claims, 11 Drawing Sheets

COMBINED LIGHT EMITTING DISCHARGE LAMP AND LUMINAIRE USING SUCH LAMP

BACKGROUND OF THE INVENTION

1. Field of the Invention

The present invention relates to a discharge lamp and a luminaire.

2. Description of the Prior Art

Currently, colors reproduced by a variety of light sources are evaluated quantitatively based on the color rendering index, which has been an established method for quantitative evaluation of colors. The color rendering index evaluates quantitatively how faithfully light of interest reproduces colors, compared with a reference light. Recently, however, more attention has been paid to how desirably colors are reproduced, apart from the faithful reproduction. It has become increasingly important to illuminate colors in our living space such as colors of human skin, food, plants, interior decorations and clothes desirably.

At the present, discharge lamps for general illumination having a relatively high correlated color temperature ranging from about 5000 K to about 7000 K are commonly used for main illumination in houses and stores. However, it is said that lamps with a low color temperature from about 2800 to 4500 K are more suitable to create a relaxed atmosphere in the illuminated space than lamps with a high color temperature. For this reason, a light source with a low color temperature is gaining its popularity gradually year by year in the field of illumination in houses and stores.

Furthermore, a lamp with a high color temperature is more dazzling than a lamp with a low color temperature when the light source is viewed directly. Moreover, an incandescent lamp for downlight tends to be used together with a lamp for main illumination as a recent approach for illumination in houses and stores. When a lamp with a high color temperature is used for main illumination and an incandescent lamp is used additionally, the difference in color between the lamp with a high color temperature and the incandescent lamp causes a sense of incongruity.

As described above, although lamps with a low color temperature are thought to be suitable to create a relaxed atmosphere, lamps in a conventional low color temperature range of about 3700 K or less are believed to pose a problem as to how colors look under the lamps. For example, such a lamp allows an object illuminated such as a new tatami mat to look yellowish like an old mat, or the skin of a Japanese person to look unnatural, even though the lamp has a high color rendering index so that it can reproduce colors faithfully and emits three lights of blue, green and red as main emission. Thus, the color of the object illuminated is not reproduced desirably. Furthermore, there is another problem in that a white object such as a paper or a white shirt does not look white, namely, the lamp cannot provide high perception of white. It is also said that a lamp in a conventional low temperature range cannot provide sufficient color identification because natural colors are not reproduced, and it is more difficult to distinguish similar colors under such a lamp.

SUMMARY OF THE INVENTION

Therefore, with the foregoing in mind, it is the object of the present invention to provide a discharge lamp and a luminaire primarily emitting combined lights in blue, green and red spectral regions that allows improved reproduction of natural colors of various colored objects, is not overly dazzling, and barely causes a sense of incongruity when used with an incandescent lamp.

In order to solve the above-described problems, a first discharge lamp of the present invention radiates visible light including the following lights combined: light having an emission peak in 400 to 490 nm wavelength range in a blue spectral region; light having an emission peak in a 500 to 550 nm wavelength range in a green spectral region; and light having with an emission peak in 600 to 670 nm wavelength range in a red spectral region. The color point of the combined light lies within a region common to the following regions: a region bounded by an ellipse with a color point (u, v)=(0.224, 0.330) as its center, a major axis of 0.056, a minor axis of 0.024, and an angle from the u axis of 20 degrees in the CIE 1960 UCS diagram; a region bounded by an ellipse with a color point (u, v)=(0.224, 0.330) as its center, a major axis of 0.078, a minor axis of 0.014, and an angle from the u axis of 30 degrees in the CIE 1960 UCS diagram; a region bounded by an ellipse with a color point (u, v)=(0.235, 0.335) as its center, a major axis of 0.060, a minor axis of 0.030, and an angle from the u axis of 30 degrees in the CIE 1960 UCS diagram; a region bounded by an ellipse with a color point (u, v)=(0.225, 0.330) as its center, a major axis of 0.060, a minor axis of 0.018, and an angle from the u axis of 20 degrees in the CIE 1960 UCS diagram; and a region on a side of color temperature lower than an isotemperature line of a correlated color temperature of 3500 K.

This embodiment achieves a discharge lamp with a low color temperature primarily radiating combined lights in blue, green and red spectral regions that provides excellent color discrimination (identification) and is not overly dazzling.

The visible light radiated by this discharge lamp includes radiation of atoms or molecules exited by radiation or discharge from a phosphor.

A second discharge lamp of the present invention radiates visible light including the following lights combined: light having an emission peak in 400 to 490 nm wavelength range in a blue spectral region; light having an emission peak in a 500 to 550 nm wavelength range in a green spectral region; and light having with an emission peak in 600 to 670 nm wavelength range in a red spectral region. The color point of the combined light lies within a region bounded by lines connecting four color points (u, v)=(0.235, 0.342), (0.252, 0.345), (0.248, 0.338), and (0.239, 0.334) in the CIE 1960 UCS diagram.

This embodiment achieves a discharge lamp with a low color temperature primarily radiating combined lights in blue, green and red spectral regions that allows an illuminated white object to be perceived as white (i.e., provides excellent perception of white) and is not overly dazzling.

A third discharge lamp of the present invention radiates visible light including the following lights combined: light having an emission peak in 400 to 490 nm wavelength range in a blue spectral region; light having an emission peak in a 500 to 550 nm wavelength range in a green spectral region; and light having with an emission peak in 600 to 670 nm wavelength range in a red spectral region. The color point of the combined light lies within a region common to the following regions: a region bounded by an ellipse with a color point (u, v)=(0.224, 0.330) as its center, a major axis of 0.056, a minor axis of 0.024, and an angle from the u axis of 20 degrees in the CIE 1960 UCS diagram; a region bounded by an ellipse with a color point (u, v)=(0.224, 0.330) as its center, a major axis of 0.078, a minor axis of 0.014, and an angle from the u axis of 30 degrees in the CIE 1960 UCS diagram; a region bounded by an ellipse with a color point (u, v)=(0.235, 0.335) as its center, a major axis of 0.060, a minor axis of 0.030, and an angle from the u axis of 30 degrees in the CIE 1960 UCS diagram; a region bounded by an ellipse with a color point (u, v)=(0.225, 0.330) as its center, a major axis of 0.060, a minor axis of 0.018, and an angle from the u axis of 20 degrees in the CIE 1960 UCS diagram; and a region bounded by lines connecting four color points: (u, v)=(0.235, 0.342), (0.252, 0.345), (0.248, 0.338), and (0.239, 0.334) in the CIE 1960 UCS diagram.

This embodiment achieves a discharge lamp that has both of the advantages of the first and second discharge lamps.

In the first, second and third discharge lamps, the color point of the combined light preferably lies within a region on a side of color temperature lower than an isotemperature line of a correlated color temperature of 3400 K in the CIE 1960 UCS diagram.

This embodiment provides an advantage in that when the discharge lamp is used with an incandescent lamp, a sense of incongruity is barely caused by the difference in colors of lights emitted from the light sources, in addition to the advantages provided by the first, second or third discharge lamp.

In the first, second and third discharge lamps, the color point of the combined light preferably lies within a circle having a center thereof at a color point (u, v)=(0.2457, 0.3403) and a radius of 0.003 in the CIE 1960 UCS diagram.

This embodiment ensures the advantages of providing excellent discrimination and perception of white, low levels of glare, and low levels of a sense of incongruity when the discharge lamp is used with an incandescent lamp.

A fourth discharge lamp having the characteristics of the first, second, or third discharge lamp is a fluorescent lamp. The fluorescent lamp includes a fluorescent layer including three phosphors having emission peaks in 400 to 490 nm, 500 to 550 nm, and 600 to 670 nm wavelength ranges as main components.

This embodiment achieves a discharge lamp with a low color temperature primarily radiating combined lights in blue, green and red spectral regions that provides excellent color discrimination and perception of white, and is not overly dazzling.

In the fourth discharge lamp, the fluorescent layer preferably includes the following three phosphors as main components: at least one bivalent europium activated blue phosphor having an emission peak in a 400 to 490 nm wavelength range; at least one phosphor selected from the group consisting of bivalent manganese activated, trivalent terbium activated, trivalent terbium and trivalent cerium activated, and bivalent manganese and trivalent terbium activated green phosphors having an emission peak in a 500 to 550 nm wavelength range; and at least one phosphor selected from the group consisting of trivalent europium activated, bivalent manganese activated, and tetravalent manganese activated red phosphors having an emission peak in a 600 to 670 nm wavelength range.

This embodiment achieves a discharge lamp with a low color temperature primarily radiating combined lights in blue, green and red spectral regions that provides excellent color discrimination or perception of white, and is not overly dazzling.

A fifth discharge lamp having the characteristics of the first, second, or third discharge lamp is a fluorescent lamp. The fluorescent lamp includes a fluorescent layer including four phosphors having emission peaks in 400 to 490 nm, 500 to 535 nm, 540 to 550 nm, and 600 to 670 nm wavelength ranges as main components.

This embodiment achieves a discharge lamp with a low color temperature primarily radiating combined lights in blue, green and red spectral regions that provides excellent color discrimination or perception of white, and is not overly dazzling.

In the fifth discharge lamp, the fluorescent layer preferably includes the following four phosphors as main components: at least one bivalent europium activated blue phosphor having an emission peak in a 400 to 490 nm wavelength range; at least one phosphor selected from the group consisting of bivalent manganese activated, and bivalent manganese and bivalent europium activated green phosphors having an emission peak in a 500 to 535 nm wavelength range; at least one phosphor selected from the group consisting of trivalent terbium activated, trivalent terbium and trivalent cerium activated, and bivalent manganese and trivalent terbium activated green phosphors having an emission peak in a 540 to 550 nm wavelength range; and at least one phosphor selected from the group consisting of trivalent europium activated, bivalent manganese activated, and tetravalent manganese activated red phosphors having an emission peak in a 600 to 670 nm wavelength range.

This embodiment achieves a discharge lamp with a low color temperature primarily radiating combined lights in blue, green and red spectral regions that provides excellent color discrimination or perception of white and is not overly dazzling.

A first luminaire includes at least one selected from the group consisting of a transmitting plate and a reflecting plate for radiating illumination light including the following lights combined: light having an emission peak in 400 to 490 nm wavelength range in a blue spectral region; light having an emission peak in a 500 to 550 nm wavelength range in a green spectral region; and light having with an emission peak in 600 to 670 nm wavelength range in a red spectral region. The color point of the illumination light lies within a region common to the following regions: a region bounded by an ellipse with a color point (u, v)=(0.224, 0.330) as its center, a major axis of 0.056, a minor axis of 0.024, and an angle from the u axis of 20 degrees in the CIE 1960 UCS diagram; a region bounded by an ellipse with a color point (u, v)=(0.224, 0.330) as its center, a major axis of 0.078, a minor axis of 0.014, and an angle from the u axis of 30 degrees in the CIE 1960 UCS diagram; a region bounded by an ellipse with a color point (u, v)=(0.235, 0.335) as its center, a major axis of 0.060, a minor axis of 0.030, and an angle from the u axis of 30 degrees in the CIE 1960 UCS diagram; a region bounded by an ellipse with a color point (u, v)=(0.225, 0.330) as its center, a major axis of 0.060, a minor axis of 0.018, and an angle from the u axis of 20 degrees in the CIE 1960 UCS diagram; and a region on a side of color temperature lower than an isotemperature line of a correlated color temperature of 3500 K.

In this embodiment, the illumination light that has transmitted the transmitting plate or reflected from the reflecting plate primarily consists of lights in blue, green and red spectral regions and has a low color temperature, and the luminaire provides excellent color discrimination (identification) and is not overly dazzling.

A second luminaire includes at least one selected from the group consisting of a transmitting plate and a reflecting plate for radiating illumination light including the following lights combined: light having an emission peak in 400 to 490 nm wavelength range in a blue spectral region; light having an emission peak in a 500 to 550 nm wavelength range in a green spectral region; and light having with an emission peak in 600 to 670 nm wavelength range in a red spectral region. The color point of the illumination light lies within a region bounded by lines connecting four color points (u, v)=(0.235, 0.342), (0.252, 0.345), (0.248, 0.338), and (0.239, 0.334) in the CIE 1960 UCS diagram.

In this embodiment, the illumination light that has transmitted the transmitting plate or reflected from the reflecting plate primarily consists of lights in blue, green and red spectral regions and has a low color temperature, and the luminaire provides excellent perception of white and is not overly dazzling.

A third luminaire includes at least one selected from the group consisting of a transmitting plate and a reflecting plate for radiating illumination light comprising the following lights combined: light having an emission peak in 400 to 490 nm wavelength range in a blue spectral region; light having an emission peak in a 500 to 550 nm wavelength range in a green spectral region; and light having with an emission peak in 600 to 670 nm wavelength range in a red spectral region. The color point of the illumination light lies within a region common to the following regions: a region bounded by an ellipse with a color point (u, v)=(0.224, 0.330) as its center, a major axis of 0.056, a minor axis of 0.024, and an angle from the u axis of 20 degrees in the CIE 1960 UCS diagram; a region bounded by an ellipse with a color point (u, v)=(0.224, 0.330) as its center, a major axis of 0.078, a minor axis of 0.014, and an angle from the u axis of 30 degrees in the CIE 1960 UCS diagram; a region bounded by an ellipse with a color point (u, v)=(0.235, 0.335) as its center, a major axis of 0.060, a minor axis of 0.030, and an angle from the u axis of 30 degrees in the CIE 1960 UCS diagram; a region bounded by an ellipse with a color point (u, v)=(0.225, 0.330) as its center, a major axis of 0.060, a minor axis of 0.018, and an angle from the u axis of 20 degrees in the CIE 1960 UCS diagram; and a region bounded by lines connecting four color points: (u, v)= (0.235, 0.342), (0.252, 0.345), (0.248, 0.338), and (0.239, 0.334) in the CIE 1960 UCS diagram.

This embodiment achieves a luminaire that has both of the advantages of the first and second luminaires.

In the first, second and third luminaires, the color point of the illumination light preferably lies within a region on a side of color temperature lower than an isotemperature line of a correlated color temperature of 3400 K in the CIE 1960 UCS diagram.

This embodiment provides an advantage in that the illumination light that has transmitted the transmitting plate or reflected from the reflecting plate is not overly dazzling, and a sense of incongruity is barely caused by the difference in colors of lights emitted from the light sources when the luminaire is used with an incandescent lamp, in addition to the advantage of excellent color discrimination or perception of white.

In the first, second and third luminaire, the color point of the illumination light lies within a circle having a center thereof at a color point (u, v)=(0.2457, 0.3403) and a radius of 0.003 in the CIE 1960 UCS diagram.

This embodiment achieves a luminaire radiating illumination light that is ensured to have the advantages of providing excellent discrimination and perception of white, low levels of glare and low levels of sense of incongruity when the luminaire is used with an incandescent lamp.

These and other advantages of the present invention will become apparent to those skilled in the art upon reading and understanding the following detailed description with reference to the accompanying figures.

DESCRIPTION OF THE PREFERRED EMBODIMENTS

Hereinafter, experiments for obtaining chromatic ranges in which light from a light source having a low color temperature allows desirable reproduction of the color of a colored object will be described with reference to the accompanying drawings.

First, experiments were conducted to study color discrimination (identification) for the colors often used in a house under various lamps having different colors of light emitted from the light sources. In the experiments, it was determined how easily observers were able to discern colors typically used in a house, i.e., black and dark blue, red, blue, and green. The observers judged a difference in colors of color charts for a target color by varying the color difference of the color.

Figure 2:
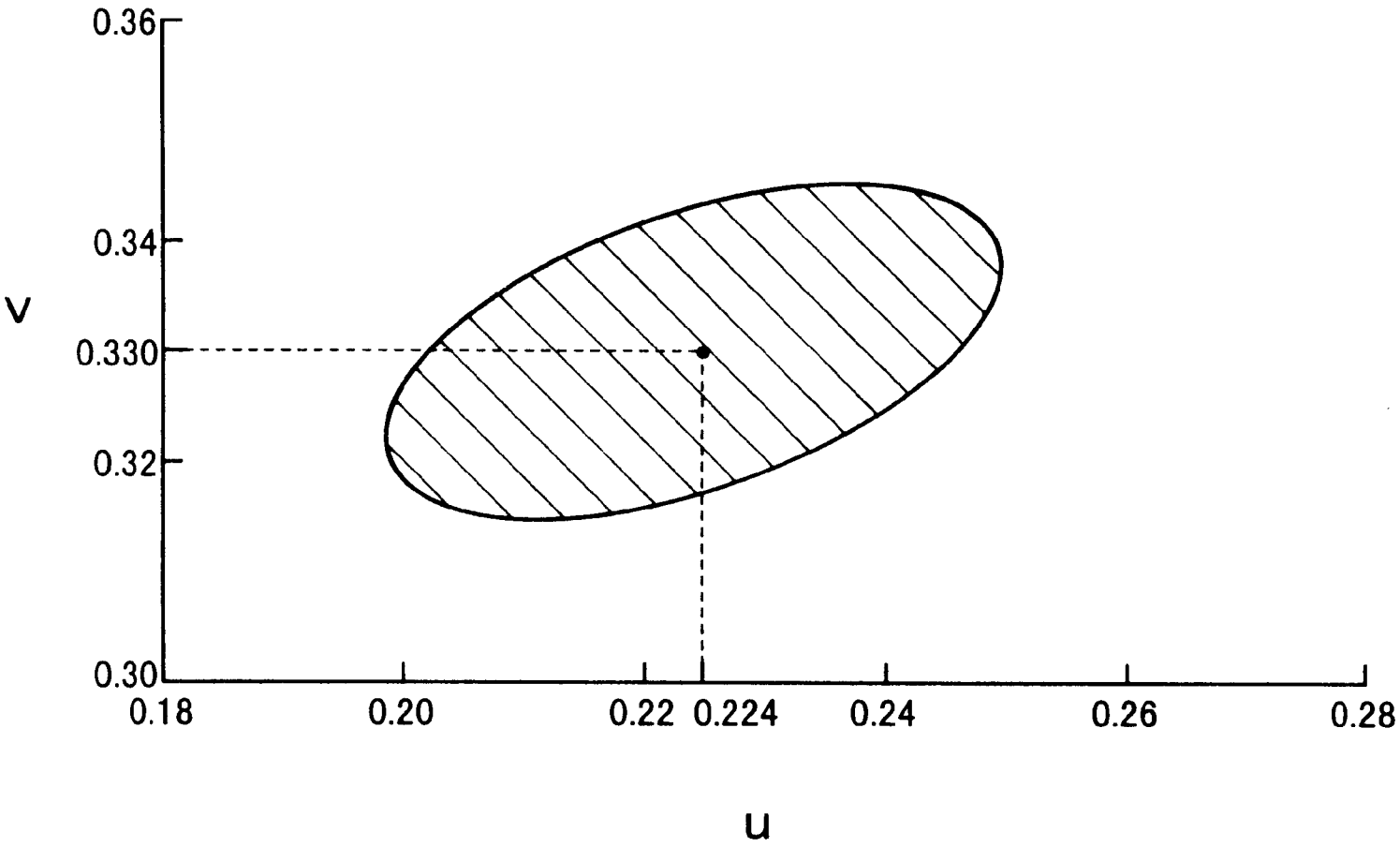
FIG. 2 is a diagram showing a chromatic range of colors of light sources that provide easy discrimination between black and dark blue colors according to the CIE 1960 UCS diagram.

FIG. 2 shows the experimental results regarding the ease of discernment of black and dark blue colors. It was found that when the color point of a light source lies within a region bounded by an ellipse with a color point (u, v)=(0.224, 0.330) as its center, a major axis of 0.056, a minor axis of 0.024, and an angle from the u axis of 20 degrees in the CIE 1960 UCS diagram, 75% or more of the observers were able to discern colors whose color difference is at least 2 in the CIE 1976 L*a*b* color space.

Figure 3:
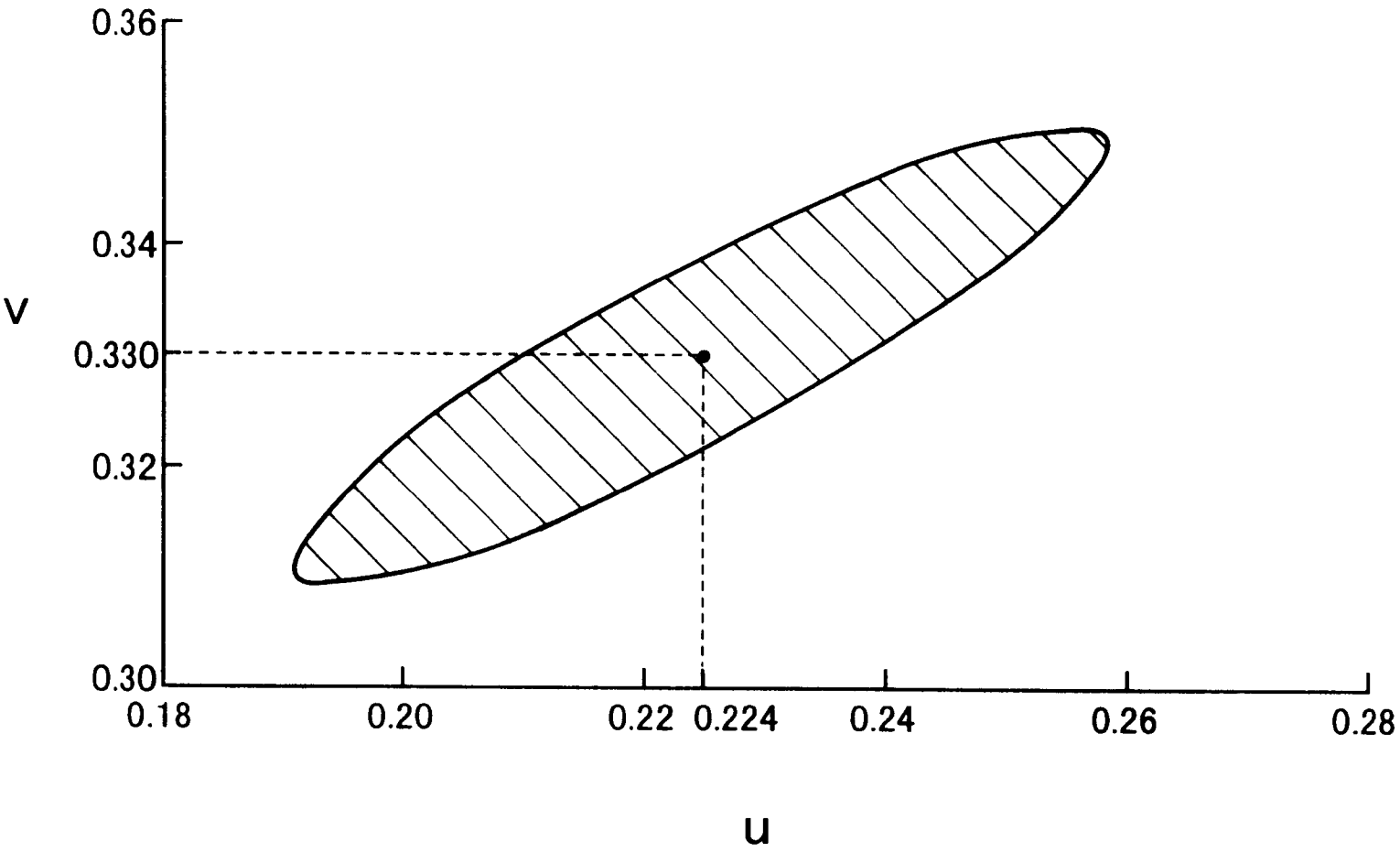
FIG. 3 is a diagram showing a chromatic range of colors of light sources that provide easy recognition of red color according to the CIE 1960 UCS diagram.

FIG. 3 shows the experimental results regarding the ease of discernment of red color. It was found that when the color point of the emission color of a light source lies within a region bounded by an ellipse with a color point (u, v)=(0.224, 0.330) as its center, a major axis of 0.078, a minor axis of 0.014, and an angle from the u axis of 30 degrees in the CIE 1960 UCS diagram, 75% or more of the observers were able to discern colors whose color difference is at least 2 in the CIE 1976 L*a*b* color space.

Figure 4:
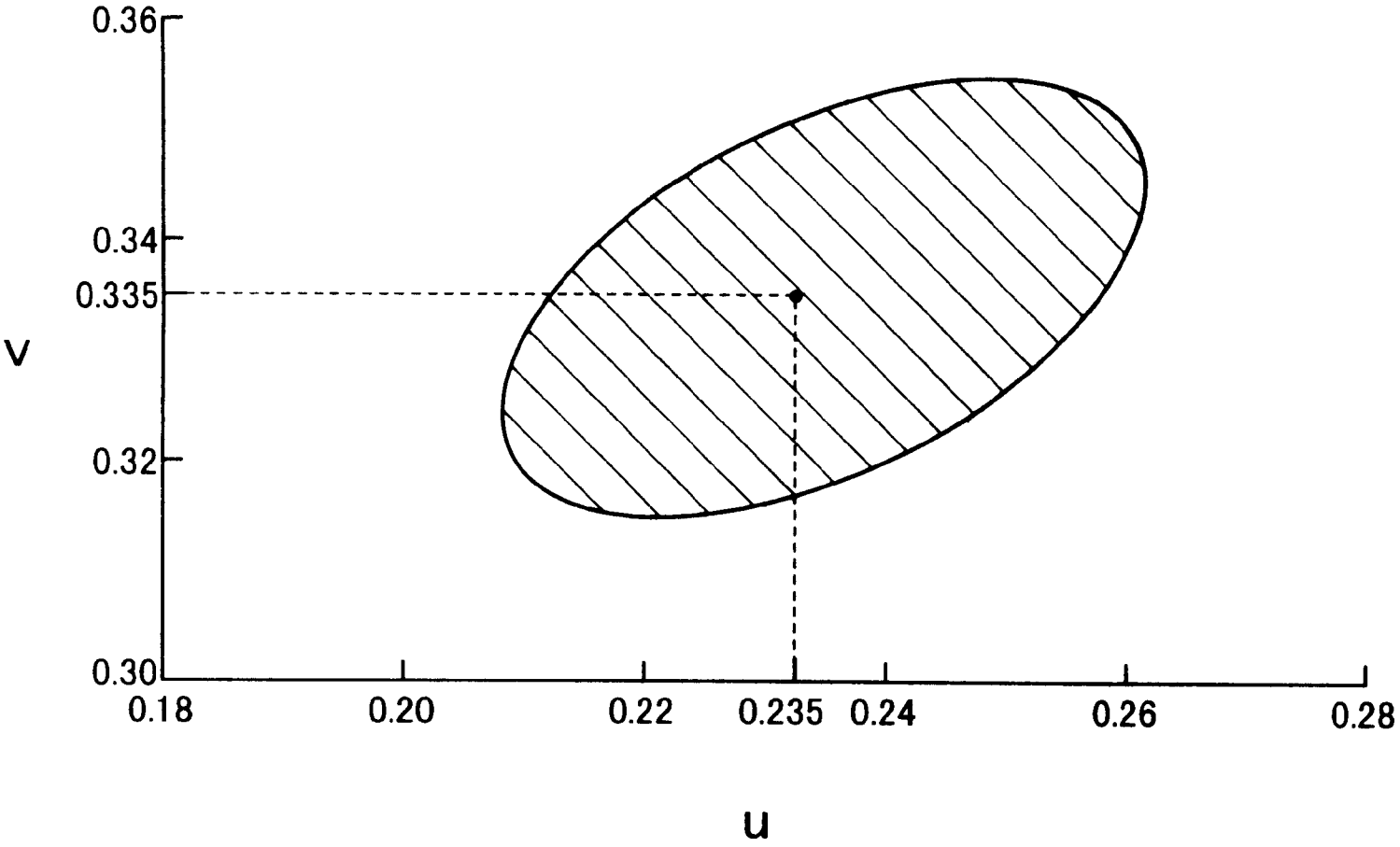
FIG. 4 is a diagram showing a chromatic range of colors of light sources that provide easy recognition of blue color according to the CIE 1960 UCS diagram.

FIG. 4 shows the experimental results regarding the ease of discernment of blue color. It was found that when the color point of emission color of a light source lies within a region bounded by an ellipse with a color point (u, v)=(0.235, 0.335) as its center, a major axis of 0.060, a minor axis of 0.030, and an angle from the u axis of 30 degrees in the CIE 1960 UCS diagram, 75% or more of the observers were able to discern colors whose color difference is at least 2 in the CIE 1976 L*a*b* color space.

Figure 5:
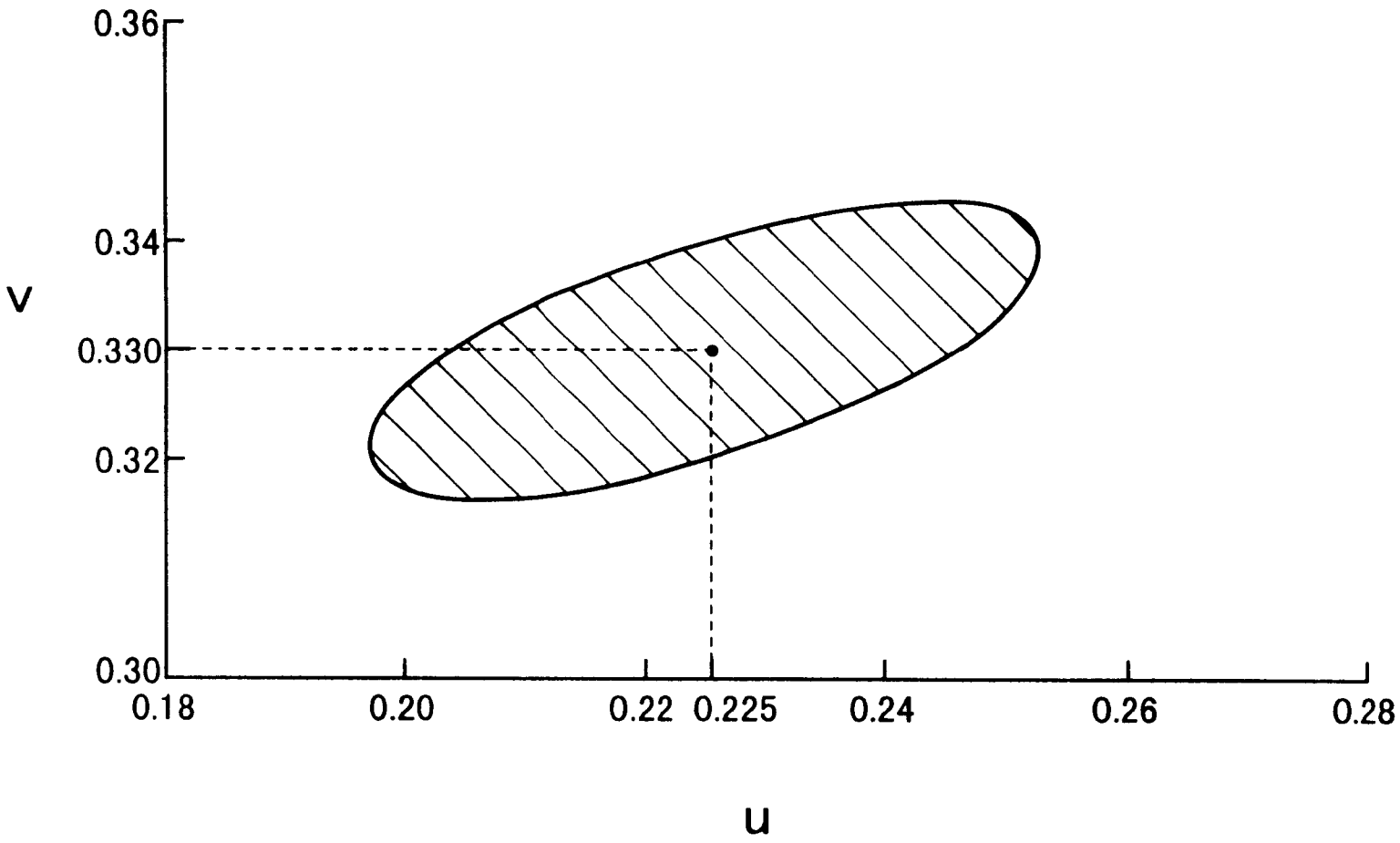
FIG. 5 is a diagram showing a chromatic range of colors of light sources that provide easy recognition of green color according to the CIE 1960 UCS diagram.

FIG. 5 shows the experimental results regarding the ease of discernment of green color. It was found that when the color point of emission color of a light source lies within a region bounded by an ellipse with a color point (u, v)=(0.225, 0.330) as its center, a major axis of 0.060, a minor axis of 0.018, and an angle from the u axis of 20 degrees in the CIE 1960 UCS diagram, 75% or more of the observers were able to discern colors whose color difference is at least 2 in the CIE 1976 L*a*b* color space.

Figure 6:
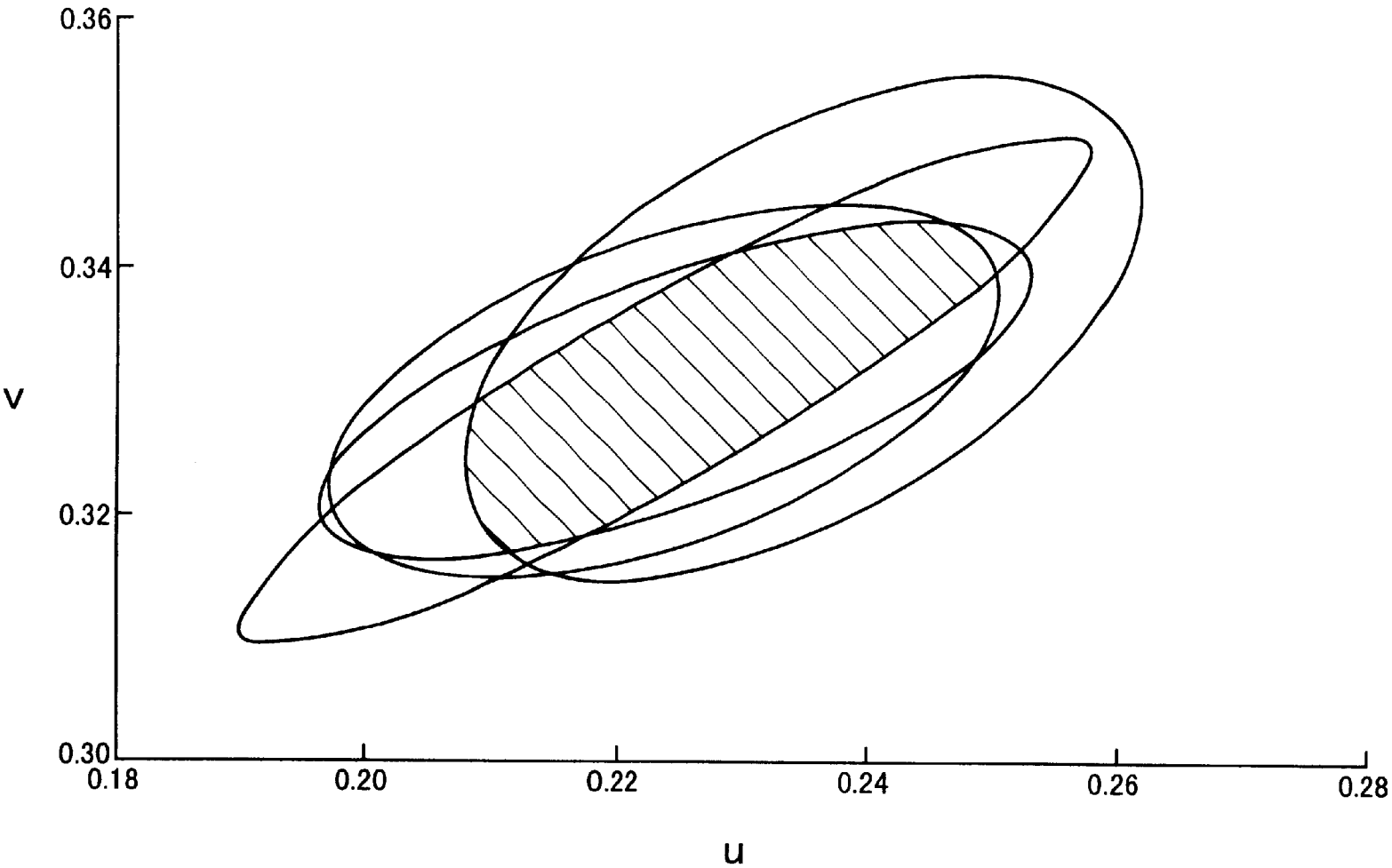
FIG. 6 is a diagram showing a chromatic range of colors of light sources that provide easy recognition of colors in all the categories according to the CIE 1960 UCS diagram.

In other words, it can be concluded that when a light source emitting light whose color point lies within a region common to all the regions bounded by the four ellipses with respect to ease of discernment of black and dark blue, red, blue, and green colors obtained by the experiments, excellent color discrimination can be achieved for colors in substantially all the categories. The range common to all the regions bounded by the four ellipses is shown as a hatched region in FIG. 6.

Next, experiments were conducted regarding the perception of white color when observing an object of an achromatic color illuminated by various lamps having different light source colors that have a low correlated color temperature of 3500 K or less.

Figure 7:
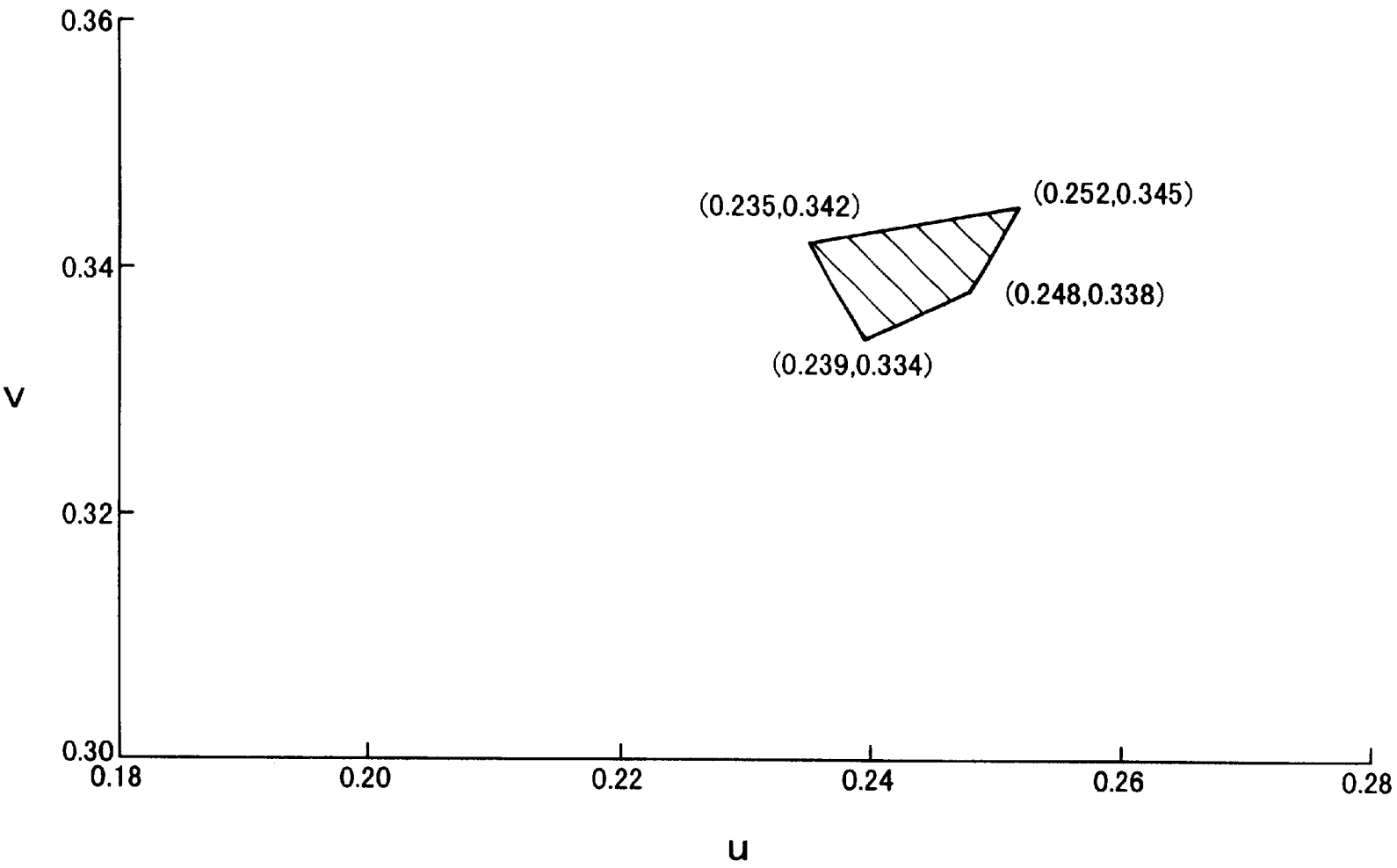
FIG. 7 is a diagram showing a chromatic range of colors of light sources that provide high perception of white color according to the CIE 1960 UCS diagram.

In the experiments, observers viewed an achromatic color chart having a Munsel value of 9 under lamps having light sources radiating different emission colors, and judged how much chromatic color and how much white color they perceived the color of the color chart to contain, and answered their perception by giving points out of 100 points in proportion to the ratio of the chromatic color and white color. A hatched region in the CIE 1960 UCS diagram in FIG. 7 is shown as a region that can provide high perception of white color. For colors in the hatched region, the observers gave 90 points or more to white color. The region is bounded by lines connecting four color points (u, v)=(0.235, 0.342), (0.252, 0.345), (0.248, 0.338), and (0.239, 0.334) in the CIE 1960 UCS diagram. Thus, it was found that light sources whose emission colors lie in this region permit a white object to be recognized as being white.

Furthermore, with respect to colors of light in a low color temperature range of 3500 K or less, perception of white color was compared between colors having the same correlated color temperature. As a result, it was found that among the light sources whose colors lie in the region bounded by lines connecting four color points (u, v)=(0.235, 0.342), (0.252, 0.345), (0.248, 0.338), and (0.239, 0.334) in the CIE 1960 UCS diagram, the light sources whose colors have a chromaticity deviation of −0.007 to −0.003 from the Planckian locus in the CIE 1960 UCS diagram ("−" indicates a chromaticity deviation toward the lower right side from the Planckian locus in the CIE 1960 UCS diagram) provide especially high perception of white color.

Another problem is glare of a light source. Glaring light not only causes discomfort to the eyes, but also interferes with accurate perception of the surroundings. The glare of a light source was also examined.

Experiments were conducted to study how much glare is caused by a light source by varying the correlated color temperature of emission color of a light source. In the experiments, the observers identified the same luminance as dazzling when viewing a light source having 3000 K.

Figure 8:
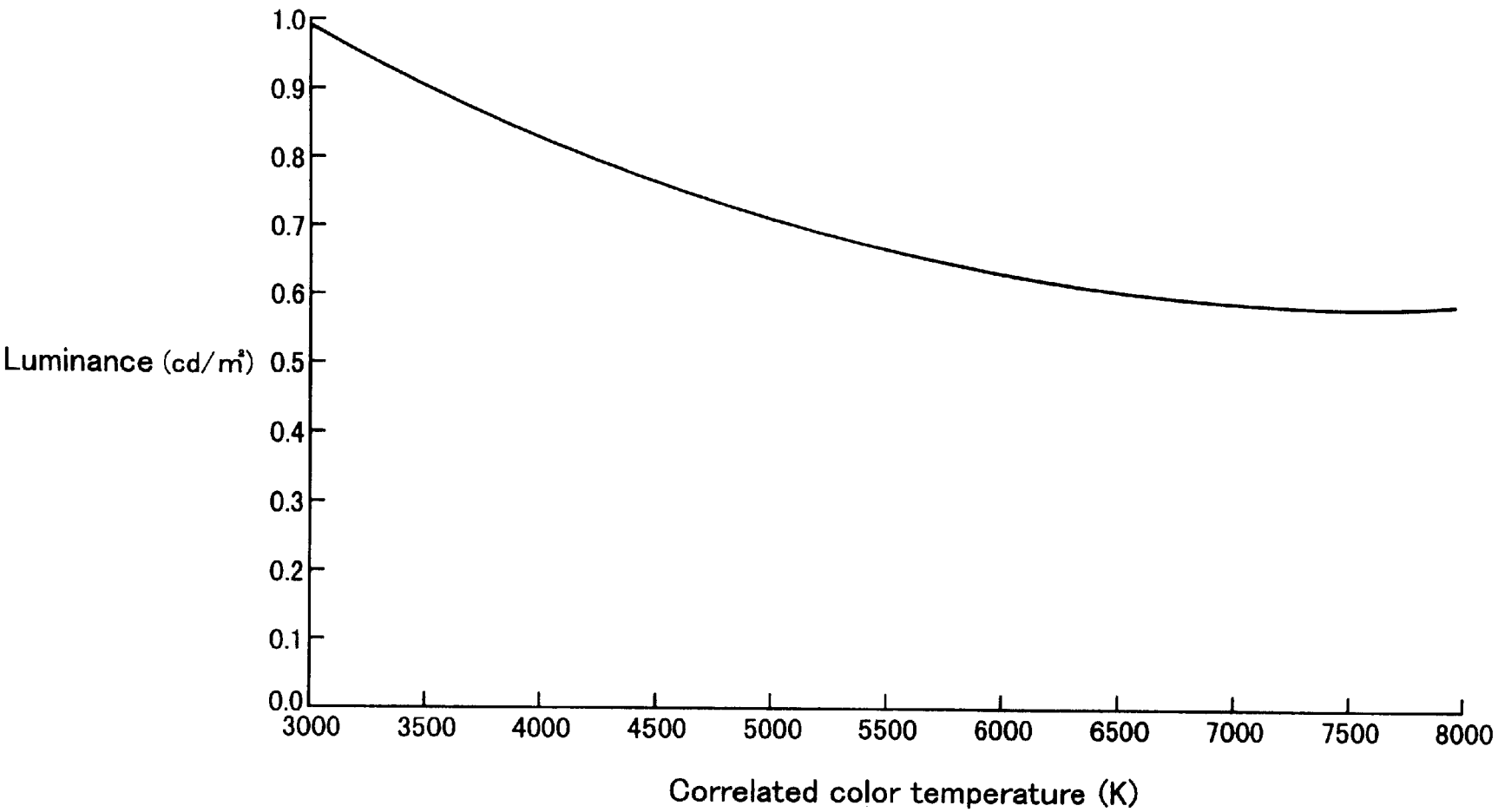
FIG. 8 is a graph showing the relationship between the correlated color temperature of light sources and the luminance of dazzling light sources.

Assuming the luminance of the light source with 3000 K as 1, the observers judged the luminance that dazzles them when viewing light sources having different correlated color temperatures. The results are shown in FIG. 8. The graph shown in FIG. 8 indicates that as the correlated color temperature (K) became higher, the luminance that dazzles the observers became lower.

As a result of further analysis, it was found that there is no significant difference in a significant level of 5% between the luminance that dazzled the observers when viewing a light source with a correlated temperature of 3500 K or less and the luminance that dazzled the observers when viewing a light source with a correlated temperature of 3000 K. More specifically, it was found that the light source with a correlated temperature of 3500 K or less causes substantially the same level of glare as that caused by the light source with a correlated temperature of 3000 K.

Next, the observers evaluated a sense of incongruity due to the difference in color between a tungsten halogen lamp with a color temperature of 2800 K and a fluorescent lamp when the lamps were illuminated simultaneously.

Figure 9:
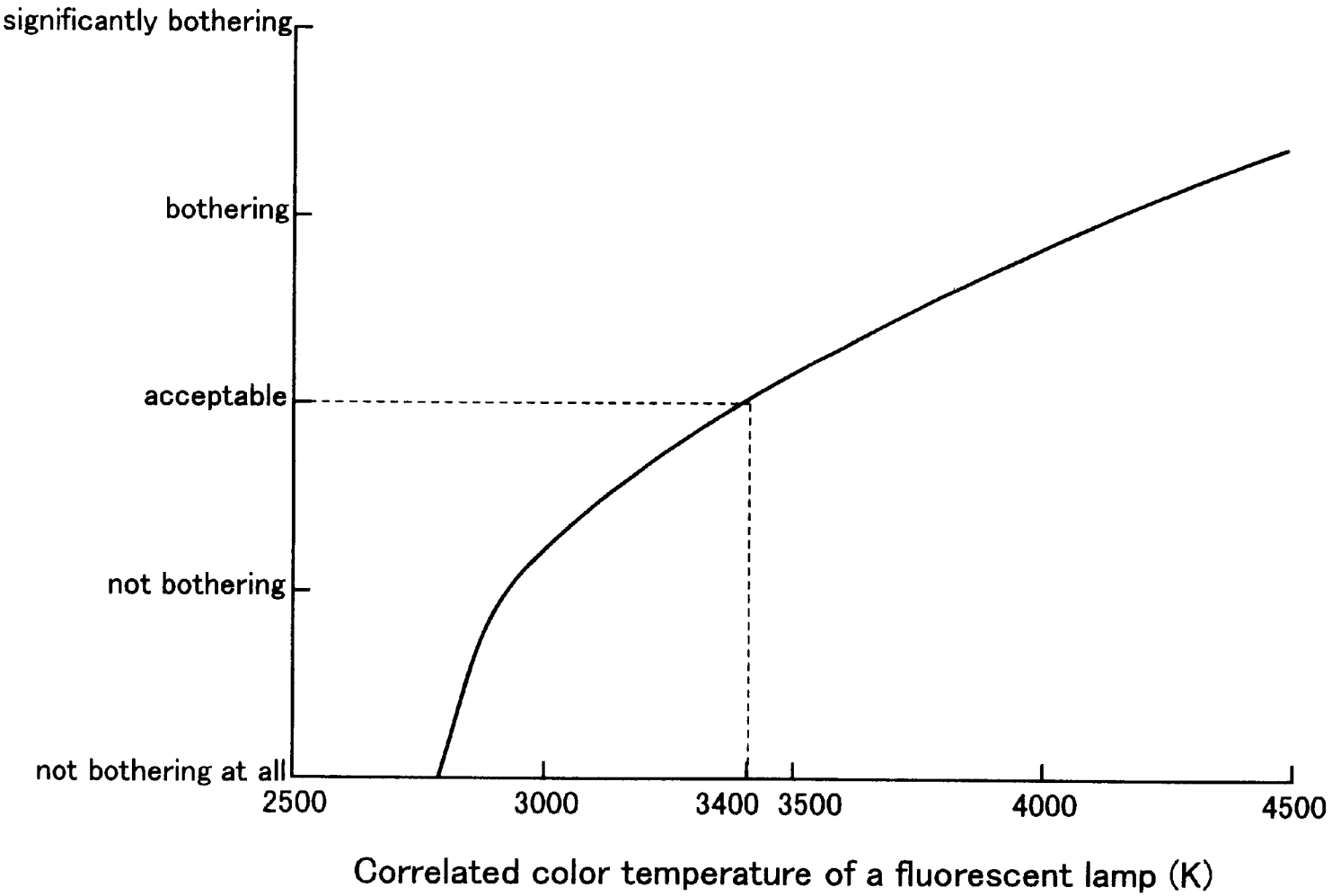
FIG. 9 is a graph showing the relationship between the correlated color temperature of light sources and the sense of incongruity caused by the difference from the color of light emitted from an incandescent lamp.

The sense of incongruity due to the difference in colors was evaluated by a method in which the observers selected one out of the following 5 categories: the difference in colors is "significantly bothering", "bothering", "acceptable", "not bothering", and "not bothering at all". The results are shown in FIG. 9. These results confirmed that as the correlated color temperature of the fluorescent lamp became higher, the difference in colors became more bothering. Thus, it was confirmed that the difference in colors is acceptable when the correlated color temperature of the fluorescent lamp is 3400 K or less.

As a result of comprehensive evaluation of the results of the visibility evaluation tests described above, it was found that when the color point of the emission color of a light source is within a circle having its center at a color point (u, v)=(0.2457, 0.3403) and a radius of 0.003 in the CIE 1960 UCS diagram, the light source has a low color temperature, provides excellent color discrimination and high perception of white color, and causes low levels of glare and sense of incongruity due to the difference in colors when used with an incandescent lamp. The region within this circle is most preferable.

Figure 1:
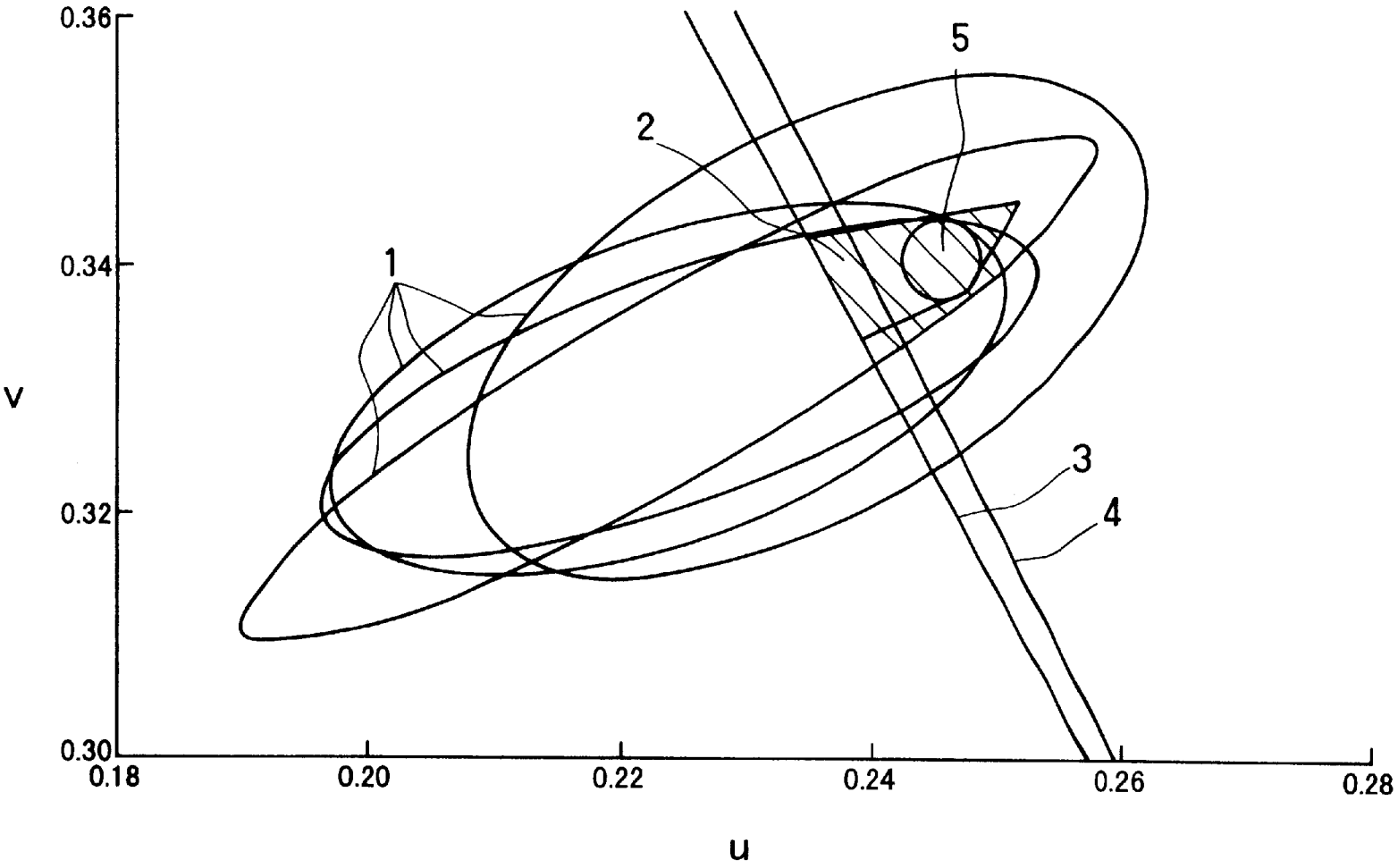
FIG. 1 is a diagram collectively showing chromatic ranges of emission colors that provide the advantages of the present invention (i.e., excellent color discrimination, high perception of white color, low levels of glare caused by illumination, and low levels of a sense of incongruity due to the difference in colors of lights emitted from the light sources when used with an incandescent lamp) and an especially preferable range, according to the CIE 1960 UCS diagram.

The chromatic ranges having the advantages of the present invention are collectively shown in the CIE 1960 UCS diagram in FIG. 1. In FIG. 1, chromatic ranges 1 encompass colors that provide excellent color discrimination. A chromatic range 2 encompasses colors that provide excellent perception of white color. A line 3 is an isotemperature line of a correlated color temperature of 3500 K, which is a boundary below which the illumination is not overly dazzling. A line 4 is an isotemperature line of a correlated color temperature of 3400 K, which is a boundary below which the difference in emission colors of the light sources barely causes the sense of incongruity when used with an incandescent lamp. A circle 5 is a most preferably region, which is a circle having its center at a color point (u, v)=(0.2457, 0.3403) and a radius of 0.003 in the CIE 1960 UCS diagram.

The light source with a low color temperature whose color lies in a range common to the range for excellent color discrimination and the range for excellent perception of white color of the present invention has a low color temperature and provides excellent color discrimination and perception of white color. Furthermore, since the color point of the above-described light source lies in a range on the side of color temperatures lower than the isotemperature line of a correlated color temperature of 3500 K, the light is not overly dazzling, in addition to providing excellent color discrimination and perception of white color. When the color point of the above-described light source lies in a range on the side of color temperatures lower than the isotemperature line of a correlated color temperature of 3400 K, the light is not overly dazzling, and the sense of incongruity is barely caused due to the difference in colors from the light sources when used with an incandescent lamp, in addition to providing excellent color discrimination and perception of white color.

In order to achieve the light source having the above-described advantages, a discharge lamp radiates at least the following visible lights combined: light having an emission peak at a 400 to 490 nm in a blue spectral region; light having an emission peak at 500 to 550 nm in a green spectral region; and light having an emission peak at 600 to 670 nm in a red spectral region. The discharge lamp can provide the advantages of the present invention by suitably selecting the radiation amount of lights in 400 to 490 nm, 500 to 550 nm and 600 to 670 nm wavelength ranges.

Radiation from atoms or molecules exited by radiation or discharge from a phosphor can be utilized to radiate the above-described visible lights.

When the discharge lamp is a fluorescent lamp, the above object can be achieved by providing the fluorescent lamp with a fluorescent layer including at least three phosphors having emission peaks in 400 to 490 nm, 500 to 550 nm and 600 to 670 nm wavelength ranges as main components.

Similarly, the above object can be achieved by providing the fluorescent lamp with a fluorescent layer including at least four phosphors having emission peaks in 400 to 490 nm, 500 to 535 nm, 540 to 550 nm and 600 to 670 nm wavelength ranges as main components.

It is well known that a green phosphor with an emission peak at 500 to 535 nm, or a red or dark red phosphor with an emission peak at 620 to 670 nm may allow the colors of various colored objects to look vivid. The present invention can be provided with this effect as well.

Examples of the phosphors that can be used when the discharge lamp is a fluorescent lamp are as follows: a bivalent europium activated blue phosphor as a phosphor with an emission peak in a 400 to 490 nm wavelength range; bivalent manganese activated, trivalent terbium activated, trivalent terbium and trivalent cerium activated, and bivalent manganese and trivalent terbium activated green phosphors as a phosphor with an emission peak in a 500 to 550 nm wavelength range; and trivalent europium activated, bivalent manganese activated, and tetravalent manganese activated red phosphor as a phosphor with an emission peak in a 600 to 670 nm wavelength range.

Furthermore, the above object can be achieved by using a bivalent manganese activated or bivalent manganese and bivalent europium activated green phosphor, which is a phosphor having an emission peak in a 500 to 535 nm wavelength range, along with the above-described phosphors. Table 1 is a list showing phosphor materials that can be used to achieve the present invention.

TABLE 1

| Phosphor | Abbreviation | Peak wave-length | Emission color |
|---|---|---|---|
| europium activated strontium phosphate | SPE | 434 nm | blue |
| europium activated barium magnesium aluminate | BAM | 450 nm | blue |
| europium activated strontium chloroapatite | SCA | 450 nm | blue |
| europium activated strontium aluminate | SAE | 490 nm | bluish green |
| europium and manganese activated barium magnesium aluminate | BAM-Mn | 515 nm | green |
| manganese activated cerium magnesium aluminate | CMM | 518 nm | green |
| manganese activated zinc silicate | ZSM | 525 nm | green |
| terbium activated cerium magnesium aluminate | CAT | 545 nm | green |
| cerium and terbium activated lanthanum phosphate | LAP | 545 nm | green |
| terbium and manganese activated cerium magnesium aluminate | CAM | 545 nm<br>518 nm | green |
| europium activated yttrium oxide | YOX | 611 nm | red |
| europium activated yttrium phosphate vanadate | PW | 621 nm | red |
| europium activated yttrium oxysulfide | YOS | 627 nm | red |
| manganese activated cerium gadolinium borate | CBM | 628 nm | red |
| manganese activated fluoromagnesium germanate | MFG | 658 nm | dark red |

Figure 10:
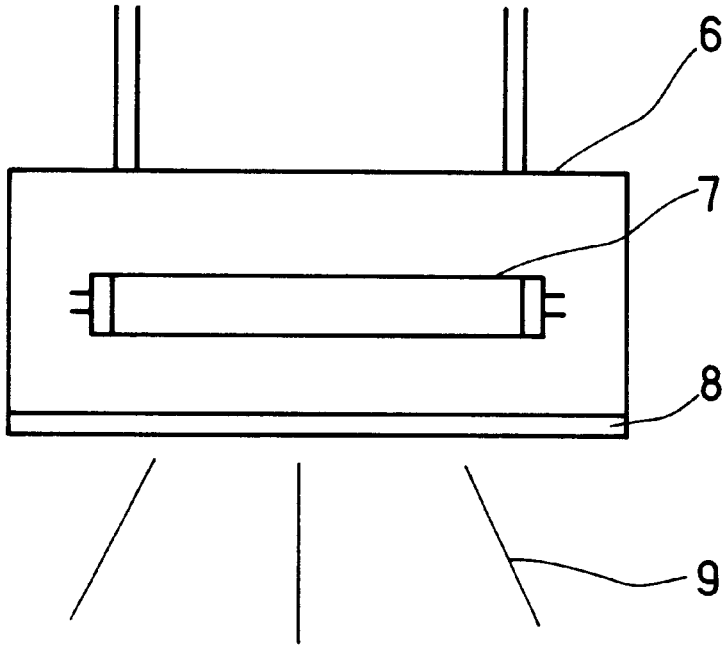
FIG. 10 is a view showing an example of a luminaire of an embodiment of the present invention.

The object of the present invention of improving reproduction of colors of various colored objects illuminated can be achieved by using a luminaire having at least one of a transmitting plate and a reflecting plate that allow light from a light source to have suitable chromaticity. FIG. 10 shows an example of a luminaire of one embodiment of the present invention.

This luminaire includes a luminaire housing 6, a lamp 7 provided in the housing 6, and a transmitting plate 8 provided in a light release port. Light from the lamp 7 passes through the transmitting plate 8, and the transmitted light 9 is utilized as illumination light. The transmitting plate 8 is designed to release light that has chromaticity in a range that can provide the advantages of the present invention.

More specifically, the transmitting plate 8 generally can be produced with glass or plastics, and the spectral transmittance in a visible light range of the transmitting plate 8 is controlled and designed so that an emission spectrum of light radiated from the lamp 7 can result in a desired illumination light that has the advantages of the present invention.

In order to control the spectral transmittance in a visible light range of the transmitting plate 8, a substance or substances that absorb light in a specific wavelength range are added to a material for the transmitting plate 8. Typically, when the transmitting plate 8 is formed of glass, the material is doped with metal ions that exclusively absorb light in a specific wavelength range as one component of the glass composition. When the transmitting plate 8 is formed of plastic, it is known to mix a pigment that absorbs light in a specific wavelength range with the plastic before the plastic is molded into a plate, and then to mold the material including the pigment into a plate.

Furthermore, either surface of a transparent or semi-transparent glass or plastic plate may be coated with a pigment or the like. Alternatively, the transmitting plate 8 can be produced by attaching a plastic film having a controlled spectral transmittance to either surface of the glass or plastic plate.

The example shown in FIG. 10 is a luminaire having a transmitting plate, but it is possible to use a luminaire having a housing provided with a reflecting plate that reflects light in a chromaticity range that provides the advantages of the present invention. Furthermore, the luminaire may include both a transmitting plate and a reflecting plate.

More specifically, illumination light that provides easy color discrimination (identification) of an object illuminated by light with a low color temperature and barely causes glare can be obtained by using a luminaire including at least one of a transmitting plate and a reflecting plate for radiating the following illumination light. The illumination light includes at least the following lights combined: light having an emission peak in 400 to 490 nm wavelength range in a blue spectral region; light having an emission peak in a 500 to 550 nm wavelength range in a green spectral region; and light having with an emission peak in 600 to 670 nm wavelength range in a red spectral region. The color point of the illumination light lies within a region common to the following regions: a region bounded by an ellipse with a color point (u, v)=(0.224, 0.330) as its center, a major axis of 0.056, a minor axis of 0.024, and an angle from the u axis of 20 degrees in the CIE 1960 UCS diagram; a region bounded by an ellipse with a color point (u, v)=(0.224, 0.330) as its center, a major axis of 0.078, a minor axis of 0.014, and an angle from the u axis of 30 degrees in the CIE 1960 UCS diagram; a region bounded by an ellipse with a color point (u, v)=(0.235, 0.335) as its center, a major axis of 0.060, a minor axis of 0.030, and an angle from the u axis of 30 degrees in the CIE 1960 UCS diagram; a region bounded by an ellipse with a color point (u, v)=(0.225, 0.330) as its center, a major axis of 0.060, a minor axis of 0.018, and an angle from the u axis of 20 degrees in the CIE 1960 UCS diagram; and a region on a side of color temperature lower than an isotemperature line of a correlated color temperature of 3500 K.

Furthermore, illumination light with a low color temperature that provides excellent perception of white color and barely causes glare can be obtained by using a luminaire including at least one of a transmitting plate and a reflecting plate for radiating the following illumination light. The illumination light includes at least the following lights combined: light having an emission peak in 400 to 490 nm wavelength range in a blue spectral region; light having an emission peak in a 500 to 550 nm wavelength range in a green spectral region; and light having with an emission peak in 600 to 670 nm wavelength range in a red spectral region. The color point of the illumination light lies within a region bounded by lines connecting four color points: (u, v)=(0.235, 0.342), (0.252, 0.345), (0.248, 0.338), and (0.239, 0.334) in the CIE 1960 UCS diagram. In this case, among the light sources whose emission colors lie in the region bounded by lines connecting four color points (u, v)=(0.235, 0.342), (0.252, 0.345), (0.248, 0.338), and (0.239, 0.334) in the CIE 1960 UCS diagram, the light sources whose emission colors have a chromaticity deviation of −0.007 to −0.003 from the Planckian locus in the CIE 1960 UCS diagram provide especially high perception of white color.

Illumination light provides easy color discrimination (identification) of an illuminated object and excellent perception of white color, when the following two requirements are satisfied: (1) the illumination light having transmitted the transmitting plate or reflected from the reflecting plate includes at least the following lights combined: light having an emission peak in 400 to 490 nm wavelength range in a blue spectral region; light having an emission peak in a 500 to 550 nm wavelength range in a green spectral region; and light having with an emission peak in 600 to 670 nm wavelength range in a red spectral region; and (2) the color point of the illumination light lies within a region common to the following regions: a region bounded by an ellipse with a color point (u, v)=(0.224, 0.330) as its center, a major axis of 0.056, a minor axis of 0.024, and an angle from the u axis of 20 degrees in the CIE 1960 UCS diagram; a region bounded by an ellipse with a color point (u, v)=(0.224, 0.330) as its center, a major axis of 0.078, a minor axis of 0.014, and an angle from the u axis of 30 degrees in the CIE 1960 UCS diagram; a region bounded by an ellipse with a color point (u, v)=(0.235, 0.335) as its center, a major axis of 0.060, a minor axis of 0.030, and an angle from the u axis of 30 degrees in the CIE 1960 UCS diagram; a region bounded by an ellipse with a color point (u, v)=(0.225, 0.330) as its center, a major axis of 0.060, a minor axis of 0.018, and an angle from the u axis of 20 degrees in the CIE 1960 UCS diagram; and a region bounded by lines connecting four color points: (u, v)=(0.235, 0.342), (0.252, 0.345), (0.248, 0.338), and (0.239, 0.334) in the CIE 1960 UCS diagram.

Furthermore, since the illumination light radiated from the luminaire of the present invention has a color point in a region on a side of color temperature lower than an isotemperature line of a correlated color temperature of 3500 K, the illumination light barely causes glare, in addition to the above-described advantages. Furthermore, when the illumination light radiated from the luminaire of the present invention has a color point in a region on a side of color temperature lower than an isotemperature line of a correlated color temperature of 3400 K, the illumination light barely causes a sense of incongruity due to the difference in colors of the light sources when used with an incandescent lamp, in addition to the above-described advantages.

When the color point of light having transmitted the transmitting plate or reflected from the reflecting plate is within a circle having its center at a color point (u, v)=(0.2457, 0.3403) and a radius of 0.003 in the CIE 1960 UCS diagram, the following advantages are provided: excellent color discrimination and perception of white color; low levels of glare; and low levels of a sense of incongruity due to the difference in colors when used with an incandescent lamp. The region within this circle is most preferable.

Next, evaluation tests by actual observation were conducted with respect to fluorescent lamps produced with the phosphors listed in Table 1. Table 2 shows the results.

TABLE 2

| | Fluorescent substance and weight ratio (%) | | | | | | | Color point | | Correlated temperature | Chromaticity deviation | Evaluation points | | | | |
|---|---|---|---|---|---|---|---|---|---|---|---|---|---|---|---|---|
| Lamp | BAM | SCA | LAP | CMM | YOX | YOS | CBM | u | v | Tc (K.) | Δuv | Color discrimination | Perception of white color | Glare of light source | Sense of incongruity | Comprehensive evaluation |
| a | | 11 | 44 | | 45 | | | 0.237 | 0.344 | 3410.1 | 0.0022 | Δ | Δ | ○ | Δ | Δ |
| b | | 16 | 38 | | 46 | | | 0.240 | 0.337 | 3427.9 | −0.0054 | ○ | ◎ | ○ | Δ | ○ |
| c | | 19 | 36 | | 45 | | | 0.241 | 0.333 | 3462.7 | −0.0094 | ○ | Δ | ○ | Δ | ○ |
| d | | 13 | 41 | | 46 | | | 0.241 | 0.341 | 3336.0 | −0.0023 | ○ | ○ | ○ | ○ | ○ |
| e | | 16 | 37 | | 47 | | | 0.244 | 0.337 | 3303.3 | −0.0072 | ○ | ○ | ○ | ○ | ○ |
| f | | 18 | 35 | | 47 | | | 0.245 | 0.334 | 3316.6 | −0.0103 | Δ | X | ○ | ○ | X |
| g | | 12 | 40 | | 48 | | | 0.244 | 0.342 | 3235.5 | −0.0027 | ○ | ○ | ◎ | ◎ | ◎ |
| h | | 13 | 38 | | 49 | | | 0.246 | 0.340 | 3203.3 | −0.0053 | ○ | ◎ | ◎ | ◎ | ◎ |
| i | | 15 | 37 | | 48 | | | 0.246 | 0.338 | 3229.3 | −0.0071 | ○ | ○ | ◎ | ◎ | ◎ |
| j | | 12 | 39 | | 49 | | | 0.247 | 0.342 | 3151.9 | −0.0038 | ○ | ◎ | ◎ | ◎ | ◎ |
| k | | 15 | 36 | | 49 | | | 0.248 | 0.337 | 3185.0 | −0.0089 | Δ | Δ | ◎ | ○ | Δ |
| l | | 10 | 41 | | 49 | | | 0.248 | 0.345 | 3091.0 | −0.0015 | Δ | Δ | ◎ | ◎ | Δ |
| m | | 9 | 40 | | 51 | | | 0.251 | 0.344 | 3023.2 | −0.0035 | Δ | ○ | ◎ | ◎ | ○ |
| n | | 12 | 38 | | 50 | | | 0.250 | 0.342 | 3078.4 | −0.0050 | Δ | ◎ | ◎ | ◎ | ○ |
| o | | 14 | 36 | | 50 | | | 0.251 | 0.338 | 3087.7 | −0.0091 | Δ | X | ◎ | ○ | X |
| p | | 8 | 40 | | 52 | | | 0.253 | 0.346 | 2955.3 | −0.0023 | X | X | ◎ | ◎ | X |
| q | 7 | | 34 | 15 | 44 | | | 0.238 | 0.341 | 3426.1 | −0.0009 | ○ | ○ | ○ | ○ | ○ |
| r | | 7 | 37 | | 40 | | 16 | 0.241 | 0.344 | 3294.9 | 0.0004 | Δ | Δ | ○ | ○ | Δ |
| s | 8 | | 33 | 10 | 25 | 24 | | 0.248 | 0.340 | 3148.2 | −0.0061 | ○ | ◎ | ◎ | ◎ | ◎ |

Table 2 shows lamp numbers, the types of phosphors and the weight ratio thereof, the color points in the CIE 1960 UCS diagram of the lamps, the correlated color temperature Tc of the lamps, the chromaticity deviation Δuv from the Planckian locus in the CIE 1960 UCS diagram of the lamps ("+" indicates a chromaticity deviation toward the upper left side from the Planckian locus in the CIE 1960 UCS diagram, and "−" indicates a chromaticity deviation toward the lower right side from the Planckian locus), the evaluation results of ease of color discrimination, perception of white color, glare of the light sources, a sense of incongruity with respect to an electric lamp, and comprehensive evaluation as to whether or not the lamp can create a suitable illumination environment, focusing on natural reproduction of colors.

The evaluation results of ease of color discrimination, perception of white color, glare of the light sources, a sense of incongruity with respect to an electric lamp, and the comprehensive evaluation are shown by ◎ (especially excellent or most preferable), ○ (excellent or preferable), Δ (marginally acceptable), and X (bad, not preferable).

Figure 11:
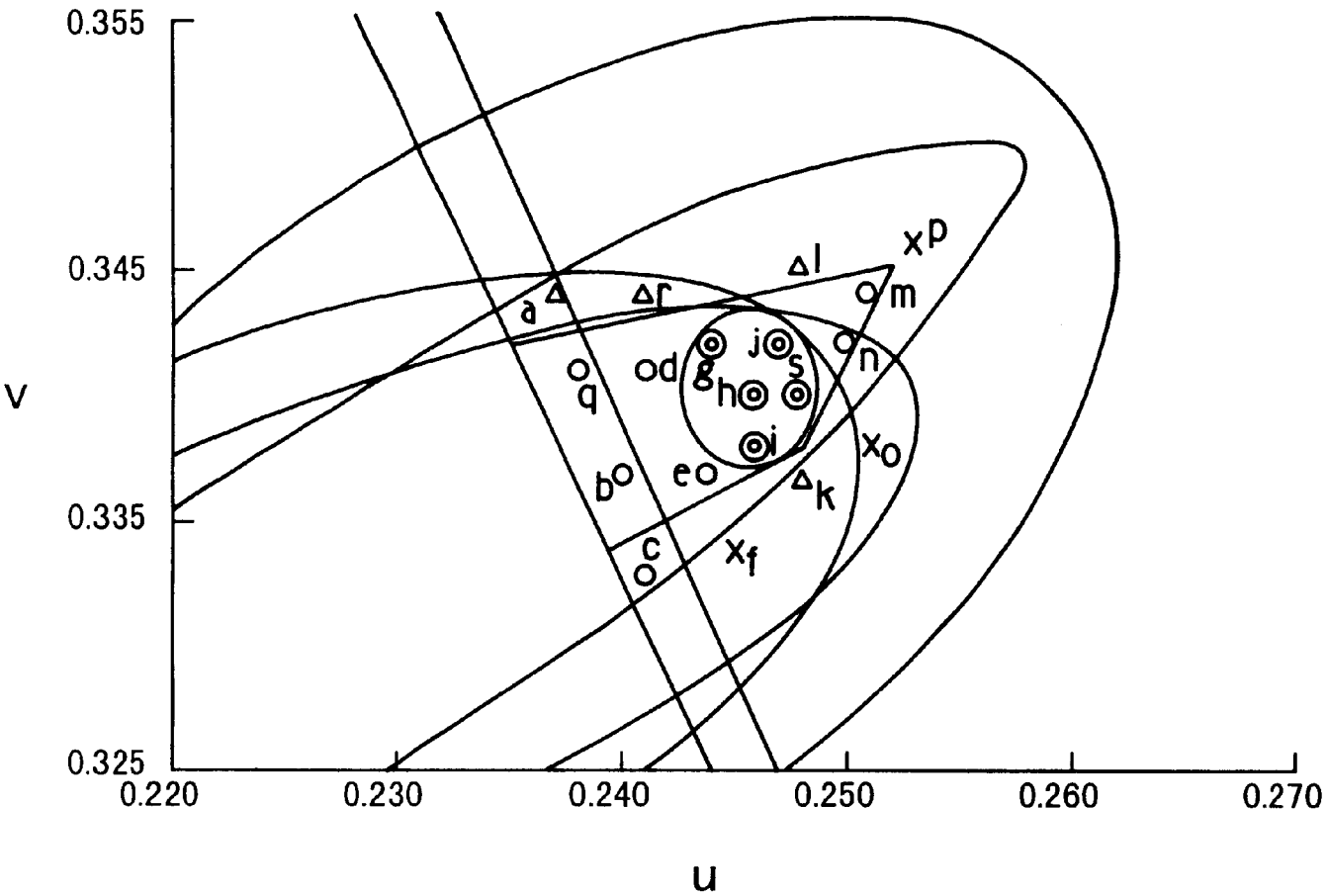
FIG. 11 is a diagram showing the color points of light emitted from fluorescent lamps produced as examples of the present invention together with the evaluation results.

FIG. 11 is a CIE 1960 UCS diagram showing the color points of emission colors of the produced and evaluated lamps shown in Table 2 together with enlarged preferable chromaticity ranges obtained from the experiments described above. In FIG. 11, the color points of the lamps are shown by ◎, ○, Δ, and X, which are the evaluation results as to whether or not the lamp can create a suitable illumination environment, focusing on natural reproduction of colors, shown in Table 2. The letters in FIG. 11 identify the lamps shown in Table 2.

The above-described plotting has confirmed the chromaticity range for colors of light that provides the advantages of the present invention. The same results were obtained when the other phosphors listed in Table 1 were used.

Furthermore, the same advantages can be obtained with a high intensity discharge lamp which utilizes visible light radiated from atoms or molecules excited by discharge.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What claimed is:

1. A discharge lamp comprising:

a blue emitting phosphor, a green emitting phosphor, and a red emitting phosphor, wherein excitation of the blue, green, and red emitting phosphors generates visible light so that visible light radiated from the discharge lamp comprises the following lights combined: light having an emission peak in a 400 to 490 nm wavelength range in a blue spectral region; light having an emission peak in a 500 to 550 nm wavelength range in a green spectral region; and light having an emission peak in a 600 to 670 nm wavelength range in a red spectral region, wherein a color point of the radiated light lies within a region common to the following regions:

a region bounded by an ellipse with a color point (u, v)=(0.224, 0.330) as a center thereof, a major axis of 0.056, a minor axis of 0.024, and an angle from the u axis of 20 degrees in the CIE 1960 UCS diagram;

a region bounded by an ellipse with a color point (u, v)=(0.224, 0.330) as a center thereof, a major axis of 0.078, a minor axis of 0.014, and an angle from the u axis of 30 degrees in the CIE 1960 UCS diagram;

a region bounded by an ellipse with a color point (u, v)=(0.235, 0.335) as a center thereof, a major axis of 0.060, a minor axis of 0.030, and an angle from the u axis of 30 degrees in the CIE 1960 UCS diagram;

a region bounded by an ellipse with a color point (u, v)=(0.225, 0.330) as a center thereof, a major axis of 0.060, a minor axis of 0.018, and an angle from the u axis of 20 degrees in the CIE 1960 UCS diagram; and a region on a side of color temperature lower than an isotemperature line of a correlated color temperature of 3500 K.

2. The discharge lamp according to claim 1, wherein a color point of the radiated light lies within a region on a side of color temperature lower than an isotemperature line of a correlated color temperature of 3400 K in the CIE 1960 UCS diagram.

3. The discharge lamp according to claim 1, wherein the discharge lamp is a fluorescent lamp that includes a fluorescent layer comprising three phosphors having emission peaks in 400 to 490 nm, 500 to 550 nm, and 600 to 670 nm wavelength ranges as main components.

4. The discharge lamp according to claim 3, wherein the fluorescent layer comprises the following three phosphors as main components:

at least one bivalent europium activated blue phosphor having an emission peak in a 400 to 490 nm wavelength range;

at least one phosphor selected from the group consisting of bivalent manganese activated, trivalent terbium activated, trivalent terbium and trivalent cerium activated, and bivalent manganese and trivalent terbium activated green phosphors having an emission peak in a 500 to 550 nm wavelength range; and at least one phosphor selected from the group consisting of trivalent europium activated, bivalent manganese activated, and tetravalent manganese activated red phosphors having an emission peak in a 600 to 670 nm wavelength range.

5. The discharge lamp according to claim 1, wherein the discharge lamp is a fluorescent lamp that includes a fluorescent layer comprising four phosphors having emission peaks in 400 to 490 nm, 500 to 535 nm, 540 to 550 nm, and 600 to 670 nm wavelength ranges as main components.

6. The discharge lamp according to claim 5, wherein the fluorescent layer comprises the following four phosphors as main components:

at least one bivalent europium activated blue phosphor having an emission peak in a 400 to 490 nm wavelength range;

at least one phosphor selected from the group consisting of bivalent manganese activated, and bivalent manganese and bivalent europium activated green phosphors having an emission peak in a 500 to 535 nm wavelength range;

at least one phosphor selected from the group consisting of trivalent terbium activated, trivalent terbium and trivalent cerium activated, and bivalent manganese and trivalent terbium activated green phosphors having an emission peak in a 540 to 550 nm wavelength range; and at least one phosphor selected from the group consisting of trivalent europium activated, bivalent manganese activated, and tetravalent manganese activated red phosphors having an emission peak in a 600 to 670 nm wavelength range.

7. A discharge lamp comprising:

a blue emitting phosphor, a green emitting phosphor, and a red emitting phosphor, wherein excitation of the blue, green, and red emitting phosphors generates visible light so that visible light radiated from the discharge lamp comprises the following lights combined: light having an emission peak in a 400 to 490 nm wavelength range in a blue spectral region; light having an emission peak in a 500 to 550 nm wavelength range in a green spectral region; and light having an emission peak in a 600 to 670 nm wavelength range in a red spectral region, wherein a color point of the radiated light lies within a region bounded by lines connecting four color points (u, v)=(0.235, 0.342), (0.252, 0.345), (0.248, 0.338), and (0.239, 0.334) in the CIE 1960 UCS diagram.

8. The discharge lamp according to claim 7, wherein a color point of the radiated light lies within a region on a side of color temperature lower than an isotemperature line of a correlated color temperature of 3400 K in the CIE 1960 UCS diagram.

9. The discharge lamp according to claim 7, wherein the discharge lamp is a fluorescent lamp that includes a fluorescent layer comprising three phosphors having emission peaks in 400 to 490 nm, 500 to 550 nm, and 600 to 670 nm wavelength ranges as main components.

10. The discharge lamp according to claim 9, wherein the fluorescent layer comprises the following three phosphors as main components:

at least one bivalent europium activated blue phosphor having an emission peak in a 400 to 490 nm wavelength range;

at least one phosphor selected from the group consisting of bivalent manganese activated, trivalent terbium activated, trivalent terbium and trivalent cerium activated, and bivalent manganese and trivalent terbium activated green phosphors having an emission peak in a 500 to 550 nm wavelength range; and at least one phosphor selected from the group consisting of trivalent europium activated, bivalent manganese activated, and tetravalent manganese activated red phosphors having an emission peak in a 600 to 670 nm wavelength range.

11. The discharge lamp according to claim 7, wherein the discharge lamp is a fluorescent lamp that includes a fluorescent layer comprising four phosphors having emission peaks in 400 to 490 nm, 500 to 535 nm, 540 to 550 nm, and 600 to 670 nm wavelength ranges as main components.

12. The discharge lamp according to claim 11, wherein the fluorescent layer comprises the following four phosphors as main components:

at least one bivalent europium activated blue phosphor having an emission peak in a 400 to 490 nm wavelength range;

at least one phosphor selected from the group consisting of bivalent manganese activated, and bivalent manganese and bivalent europium activated green phosphors having an emission peak in a 500 to 535 nm wavelength range;

at least one phosphor selected from the group consisting of trivalent terbium activated, trivalent terbium and trivalent cerium activated, and bivalent manganese and trivalent terbium activated green phosphors having an emission peak in a 540 to 550 nm wavelength range; and at least one phosphor selected from the group consisting of trivalent europium activated, bivalent manganese activated, and tetravalent manganese activated red phosphors having an emission peak in a 600 to 670 nm wavelength range.

13. A discharge lamp comprising:

a blue emitting phosphor, a green emitting phosphor, and a red emitting phosphor, wherein excitation of the blue, green, and red emitting phosphors generates visible light so that visible light radiated from the discharge lamp comprises the following lights combined: light having an emission peak in a 400 to 490 nm wavelength range in a blue spectral region; light having an emission peak in a 500 to 550 nm wavelength range in a green spectral region; and light having an emission peak in a 600 to 670 nm wavelength range in a red spectral region, wherein a color point of the radiated light lies within a region common to the following regions:

a region bounded by an ellipse with a color point (u, v)=(0.224, 0.330) as a center thereof, a major axis of 0.056, a minor axis of 0.024, and an angle from the u axis of 20 degrees in the CIE 1960 UCS diagram;

a region bounded by an ellipse with a color point (u, v)=(0.224, 0.330) as a center thereof, a major axis of 0.078, a minor axis of 0.014, and an angle from the u axis of 30 degrees in the CIE 1960 UCS diagram;

a region bounded by an ellipse with a color point (u, v)=(0.235, 0.335) as a center thereof, a major axis of 0.060, a minor axis of 0.030, and an angle from the u axis of 30 degrees in the CIE 1960 UCS diagram;

a region bounded by an ellipse with a color point (u, v)=(0.225, 0.330) as a center thereof, a major axis of 0.060, a minor axis of 0.018, and an angle from the u axis of 20 degrees in the CIE 1960 UCS diagram; and a region bounded by lines connecting four color points: (u, v)=(0.235, 0.342), (0.252, 0.345), (0.248, 0.338), and (0.239, 0.334) in the CIE 1960 UCS diagram.

14. The discharge lamp according to claim 13, wherein a color point of the radiated light lies within a region on a side of color temperature lower than an isotemperature line of a correlated color temperature of 3400 K in the CIE 1960 UCS diagram.

15. The discharge lamp according to claim 13, wherein a color point of the radiated light lies within a circle having a center at a color point (u, v)=(0.2457, 0.3403) and a radius of 0.003 in the CIE 1960 UCS diagram.

16. The discharge lamp according to claim 13, wherein the discharge lamp is a fluorescent lamp that includes a fluorescent layer comprising three phosphors having emission peaks in 400 to 490 nm, 500 to 550 nm, and 600 to 670 nm wavelength ranges as main components.

17. The discharge lamp according to claim 16, wherein the fluorescent layer comprises the following three phosphors as main components:

at least one bivalent europium activated blue phosphor having an emission peak in a 400 to 490 nm wavelength range;

at least one phosphor selected from the group consisting of bivalent manganese activated, trivalent terbium activated, trivalent terbium and trivalent cerium activated, and bivalent manganese and trivalent terbium activated green phosphors having an emission peak in a 500 to 550 nm wavelength range; and at least one phosphor selected from the group consisting of trivalent europium activated, bivalent manganese activated, and tetravalent manganese activated red phosphors having an emission peak in a 600 to 670 nm wavelength range.

18. The discharge lamp according to claim 13, wherein the discharge lamp is a fluorescent lamp that includes a fluorescent layer comprising four phosphors having emission peaks in 400 to 490 nm, 500 to 535 nm, 540 to 550 nm, and 600 to 670 nm wavelength ranges as main components.

19. The discharge lamp according to claim 18, wherein the fluorescent layer comprises the following four phosphors as main components:

at least one bivalent europium activated blue phosphor having an emission peak in a 400 to 490 nm wavelength range;

at least one phosphor selected from the group consisting of bivalent manganese activated, and bivalent manganese and bivalent europium activated green phosphors having an emission peak in a 500 to 535 nm wavelength range;

at least one phosphor selected from the group consisting of trivalent terbium activated, trivalent terbium and trivalent cerium activated, and bivalent manganese and trivalent terbium activated green phosphors having an emission peak in a 540 to 550 nm wavelength range; and at least one phosphor selected from the group consisting of trivalent europium activated, bivalent manganese activated, and tetravalent manganese activated red phosphors having an emission peak in a 600 to 670 nm wavelength range.

20. A luminaire comprising at least one selected from the group consisting of a transmitting plate and a reflecting plate for radiating illumination light, the luminaire comprising a discharge lamp including a blue emitting phosphor, a green emitting phosphor, and a red emitting phosphor, wherein excitation of the blue, green, and red emitting phosphors generates visible light comprising the following lights combined: light having an emission peak in a 400 to 490 nm wavelength range in a blue spectral region; light having an emission peak in a 500 to 550 nm wavelength range in a green spectral region; and light having an emission peak in a 600 to 670 nm wavelength range in a red spectral region, wherein a color point of the illumination light lies within a region common to the following regions:

a region bounded by an ellipse with a color point (u, v)=(0.224, 0.330) as a center thereof, a major axis of 0.056, a minor axis of 0.024, and an angle from the u axis of 20 degrees in the CIE 1960 UCS diagram;

a region bounded by an ellipse with a color point (u, v)=(0.224, 0.330) as a center thereof, a major axis of 0.078, a minor axis of 0.014, and an angle from the u axis of 30 degrees in the CIE 1960 UCS diagram;

a region bounded by an ellipse with a color point (u, v)=(0.235, 0.335) as a center thereof, a major axis of 0.060, a minor axis of 0.030, and an angle from the u axis of 30 degrees in the CIE 1960 UCS diagram;

a region bounded by an ellipse with a color point (u, v)=(0.225, 0.330) as a center thereof, a major axis of 0.060, a minor axis of 0.018, and an angle from the u axis of 20 degrees in the CIE 1960 UCS diagram; and a region on a side of color temperature lower than an isotemperature line of a correlated color temperature of 3500 K.

21. The luminaire according to claim 20, wherein a color point of the illumination light lies within a region on a side of color temperature lower than an isotemperature line of a correlated color temperature of 3400 K in the CIE 1960 UCS diagram.

22. A luminaire comprising at least one selected from the group consisting of a transmitting plate and a reflecting plate for radiating illumination light, the luminaire comprising a discharge lamp including a blue emitting phosphor, a green emitting phosphor, and a red emitting phosphor, wherein excitation of the blue, green, and red emitting phosphors generates visible light comprising the following lights combined: light having an emission peak in a 400 to 490 nm wavelength range in a blue spectral region; light having an emission peak in a 500 to 550 nm wavelength range in a green spectral region; and light having an emission peak in a 600 to 670 nm wavelength range in a red spectral region, wherein a color point of the illumination light lies within a region bounded by lines connecting four color points (u, v)=(0.235, 0.342), (0.252, 0.345), (0.248, 0.338), and (0.239, 0.334) in the CIE 1960 UCS diagram.

23. The luminaire according to claim 22, wherein a color point of the illumination light lies within a region on a side of color temperature lower than an isotemperature line of a correlated color temperature of 3400 K in the CIE 1960 UCS diagram.

24. A luminaire comprising at least one selected from the group consisting of a transmitting plate and a reflecting plate for radiating illumination light, the luminaire comprising a discharge lamp including a blue emitting phosphor, a green emitting phosphor, and a red emitting phosphor, wherein excitation of the blue, green, and red emitting phosphors generates visible light comprising the following lights combined: light having an emission peak in a 400 to 490 nm wavelength range in a blue spectral region; light having an emission peak in a 500 to 550 nm wavelength range in a green spectral region; and light having an emission peak in a 600 to 670 nm wavelength range in a red spectral region, wherein a color point of the illumination light lies within a region common to the following regions:

a region bounded by an ellipse with a color point (u, v)=(0.224, 0.330) as a center thereof, a major axis of 0.056, a minor axis of 0.024, and an angle from the u axis of 20 degrees in the CIE 1960 UCS diagram;

a region bounded by an ellipse with a color point (u, v)=(0.224, 0.330) as a center thereof, a major axis of 0.078, a minor axis of 0.014, and an angle from the u axis of 30 degrees in the CIE 1960 UCS diagram;

a region bounded by an ellipse with a color point (u, v)=(0.235, 0.335) as a center thereof, a major axis of 0.060, a minor axis of 0.030, and an angle from the u axis of 30 degrees in the CIE 1960 UCS diagram;

a region bounded by an ellipse with a color point (u, v)=(0.225, 0.330) as a center thereof, a major axis of 0.060, a minor axis of 0.018, and an angle from the u axis of 20 degrees in the CIE 1960 UCS diagram; and a region bounded by lines connecting four color points: (u, v)=(0.235, 0.342), (0.252, 0.345), (0.248, 0.338), and (0.239, 0.334) in the CIE 1960 UCS diagram.

25. The luminaire according to claim 24, wherein a color point of the illumination light lies within a region on a side of color temperature lower than an isotemperature line of a correlated color temperature of 3400 K in the CIE 1960 UCS diagram.

26. The luminaire according to claim 24, wherein a color point of the illumination light lies within a circle having a center thereof at a color point (u, v)=(0.2457, 0.3403) and a radius of 0.003 in the CIE 1960 UCS diagram.

* * * * *